US009585432B2

(12) United States Patent
Garneau et al.

(10) Patent No.: US 9,585,432 B2
(45) Date of Patent: Mar. 7, 2017

(54) SPORT HELMET

(71) Applicant: LOUIS GARNEAU SPORTS INC., St-Augustin-de-Desmaures (CA)

(72) Inventors: Louis Garneau, Saint-Augustin-de-Desmaures (CA); Dominic Hamel, Saint-Ferréol-les-Neiges (CA)

(73) Assignee: LOUIS GARNEAU SPORTS INC, St-Augustin-de-Desmaures QC (CA)

( * ) Notice: Subject to any disclaimer, the term of this patent is extended or adjusted under 35 U.S.C. 154(b) by 34 days.

(21) Appl. No.: 14/049,375

(22) Filed: Oct. 9, 2013

(65) Prior Publication Data

US 2015/0096113 A1 Apr. 9, 2015

(51) Int. Cl.
*A42B 3/06* (2006.01)

(52) U.S. Cl.
CPC ..... *A42B 3/062* (2013.01); *A42B 3/066* (2013.01)

(58) Field of Classification Search
CPC ..... A42B 3/06; A42B 3/062; A42B 3/065; A42B 3/066; A42B 3/12; A42B 3/124; A42B 3/125; A42B 3/127
USPC ..... 2/415, 425, 411, 414
See application file for complete search history.

(56) References Cited

U.S. PATENT DOCUMENTS

| | | | | | |
|---|---|---|---|---|---|
| 5,012,533 | A * | 5/1991 | Raffler | A42B 3/066 | 2/420 |
| D357,553 | S * | 4/1995 | Garneau | D29/102 | |
| D357,554 | S * | 4/1995 | Garneau | D29/102 | |
| D375,387 | S * | 11/1996 | Garneau | D29/102 | |
| D375,582 | S * | 11/1996 | Garneau | D29/102 | |
| 6,298,497 | B1 * | 10/2001 | Chartrand | 2/414 | |
| 6,647,556 | B2 * | 11/2003 | Grepper et al. | 2/425 | |
| 6,694,529 | B1 * | 2/2004 | Chiu | 2/411 | |
| 7,069,601 | B1 * | 7/2006 | Jacobsen | 2/421 | |
| 8,296,867 | B2 * | 10/2012 | Rudd et al. | 2/411 | |
| 2003/0056279 | A1 * | 3/2003 | Garneau | 2/425 | |
| 2007/0000022 | A1 * | 1/2007 | Jacobsen | 2/171 | |
| 2007/0277296 | A1 * | 12/2007 | Bullock | 2/411 | |
| 2013/0263363 | A1 * | 10/2013 | Pietrzak | 2/411 | |
| 2014/0189939 | A1 * | 7/2014 | Cheng | 2/422 | |

* cited by examiner

*Primary Examiner* — Shaun R Hurley
*Assistant Examiner* — Bao-Thieu L Nguyen
(74) *Attorney, Agent, or Firm* — Cantor Colburn LLP

(57) ABSTRACT

A helmet has an inner liner made of foam material forming a body of the helmet. The inner liner has a convex outer surface and a concave inner surface defining a cavity for receiving the wearer's head. The inner liner has a plurality of beams extending from front to rear of the helmet and spaced apart to form vents therebetween, the vents being free of foam material between adjacent beams. Rigid bridge members are comolded with the inner liner to be partially concealed in the inner liner, the at least one bridge member having at least one bridge projecting out of the foam material of two adjacent beams and extending transversely in at least one of the vents. At least one strap is provided to attach the helmet to a wearer's head.

13 Claims, 5 Drawing Sheets

SPORT HELMET

TECHNICAL FIELD

The present application relates to sport helmets, such as bicycle helmets.

BACKGROUND OF THE ART

Bicycle helmets have now become ubiquitous for the bicycling activity. In road and urban riding, one specific helmet construction has become the norm: that consisting of the foam inner liner with an outer shell. The inner liner forms the body of the helmet in terms of volume and structural integrity. The inner liner is typically made of a structural foam material such as expanded polystyrene. An outer shell covers the liner and defines the smooth and decorative exposed outer surface of the helmet. The outer shell and liner are most often co-molded. Other components include the attachment system inside the outer shell, by which the helmet is secured to the user's head.

The above-referred configuration is quite convenient in terms of providing suitable head protection, while being lightweight. Moreover, in some instances, numerous vents may be defined in the helmet to allow air circulation and the exhaust of sweat, which is often necessary in warmer riding weather.

Helmets have been shown to be non-optimal in terms of aerodynamics, notably because of the presence of such vents causing additional drag. Accordingly, helmets used in competitions have recently been designed with fewer vents to limit drag losses. For example, Time trial helmets are often with very few vents. However, such helmets may not be as comfortable in warm weather.

SUMMARY

Therefore, it is an aim of the present disclosure to provide a helmet that addresses issues associated with the prior art.

In accordance with the present disclosure, there is provided a helmet comprising: an inner liner made of foam material forming a body of the helmet, the inner liner having a convex outer surface and a concave inner surface defining a cavity for receiving the wearers, the inner liner having a plurality of beams extending from front to rear of the helmet and spaced apart to form vents therebetween, the vents being free of foam material between adjacent beams; at least one rigid bridge member comolded with the inner liner to be partially concealed in the inner liner, the at least one bridge member having at least one bridge projecting out of the foam material of two adjacent beams and extending transversely in at least one of the vents; and means to attach the helmet to a wearer's head.

DETAILED DESCRIPTION

Figure 1:
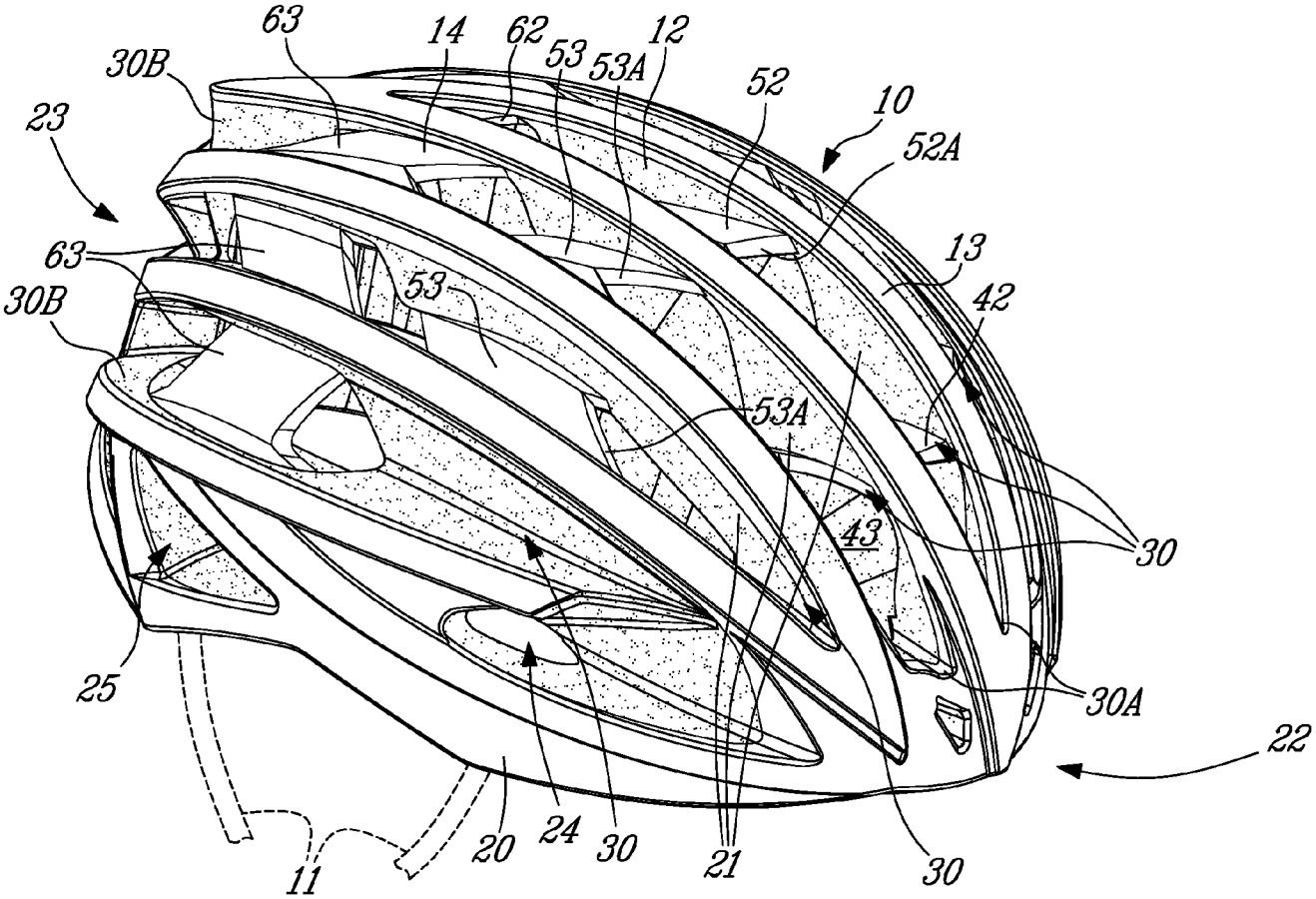
FIG. 1 is a perspective view of a sport helmet in accordance with an embodiment of the present disclosure.

Referring to the drawings, and more particularly to FIG. 1, there is illustrated a helmet 10 in accordance with the present disclosure. The helmet 10 is of the type that is used for bicycling and like sporting activities.

For simplicity, an attachment system is only summarily shown as 11. The attachment system is typically anchored to an interior of the helmet and features straps for the helmet to be strapped to the user's head. The attachment system may also comprise rigid attachment components in the rear of the helmet, to adjust the helmet to a circumference of the wearer's head. Hence, although summarily shown, the helmet 10 has such attachment means of any appropriate form.

Figure 2:
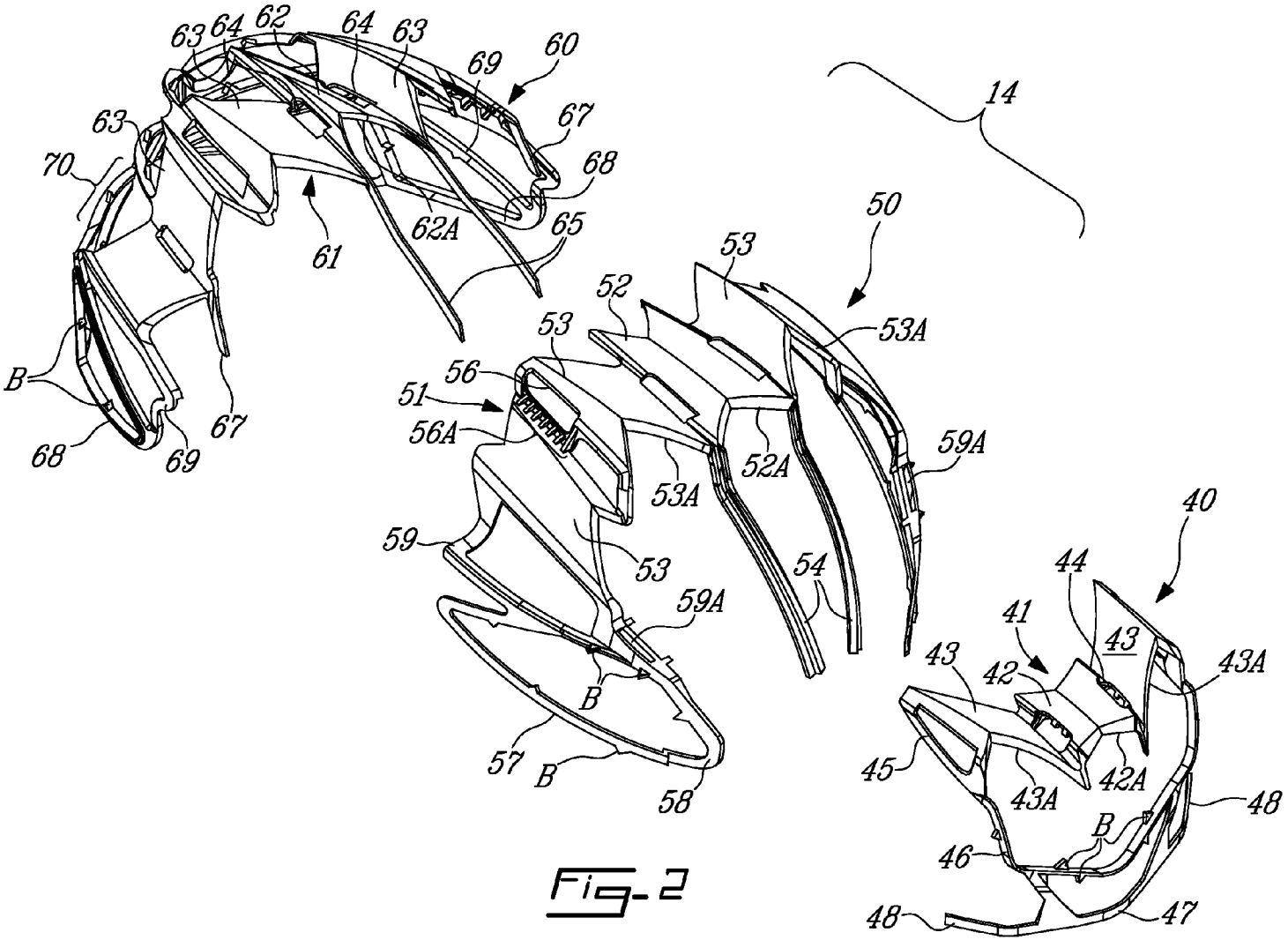
FIG. 2 is an assembly view of a cage of the helmet of FIG. 1.
Figure 3:
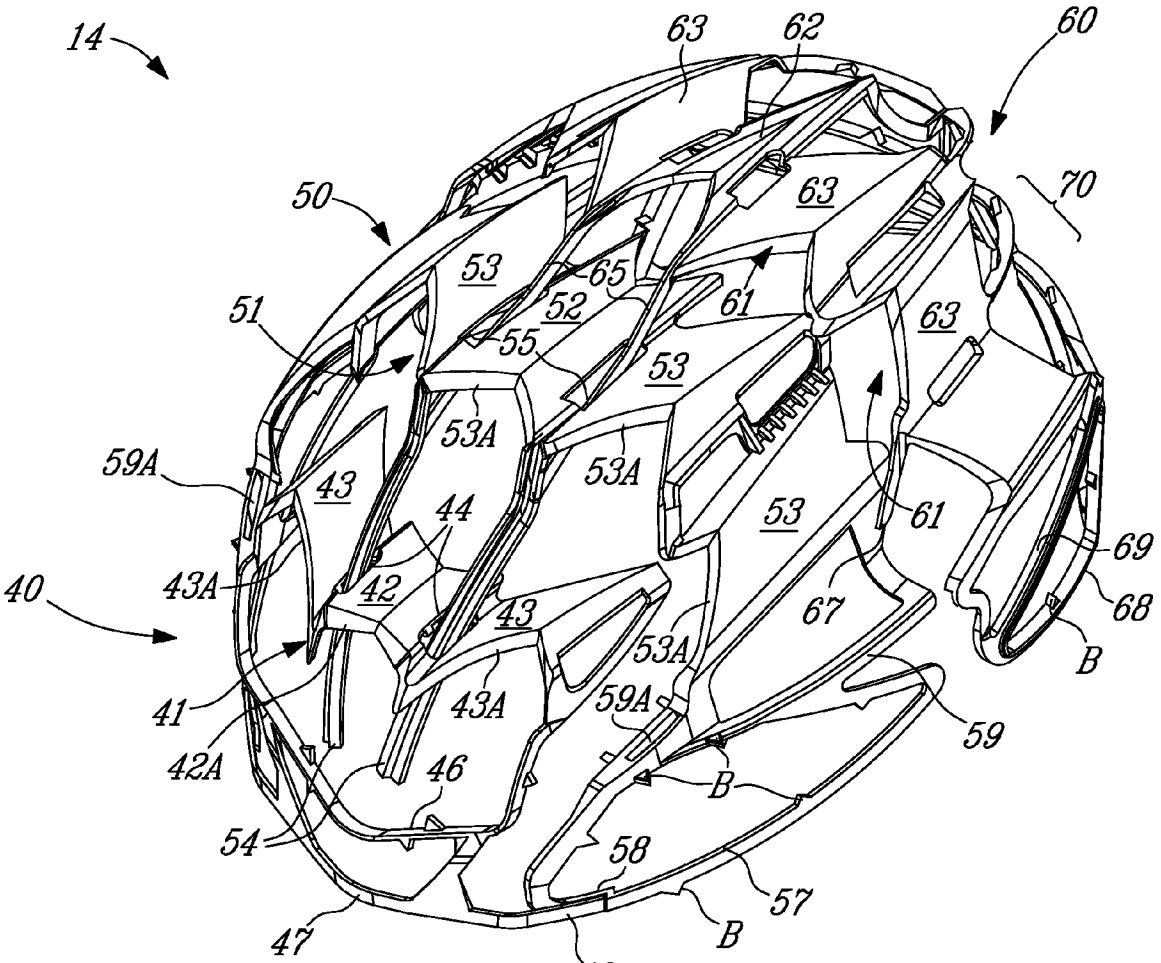
FIG. 3 is a perspective assembled view of the cage of FIG. 2.

Referring concurrently to FIGS. 1, 2 and 3, the helmet 10 has a generally hemispherical shape formed by an inner liner 12, an outer shell 13 and a cage 14. By its hemispherical shape, the helmet 10 has an inner concave surface and outer convex surface, with the top and side of the wearer's head being received in the inner concavity. It is observed that various padding layer, not shown, may be disposed against the inner concave surface, as interfaces between the inner liner 12 and the wearer's head to improve comfort.

The inner liner 12 is typically made of foam (e.g., expanded polystyrene or the like) and constitutes the major component of the helmet 10 in terms of volume. Moreover, the foam is of the type being generally rigid and hence providing the structural integrity to the helmet 10, in terms of maintaining its shape. In other words, the foam liner is not of the resilient type that is supported by a rigid shell, but rather of the type that is the main structural component of the helmet 10.

The outer shell 13 is integrally connected to the inner liner 12 and forms the major portion of the exposed convex surface of the helmet 10. The integral connection may be achieved by way of adhesives or co-molding (i.e., molding of the inner liner 12 with the outer shell 13 positioned in the mold cavity beforehand). The outer shell 13 is made of a plastic layer, such as polycarbonate or the like. The outer shell 13 defines the smooth and decorative outer surface of the helmet 10.

Cage 14 is also co-molded with the liner 12 and substantially concealed inside the inner liner 12, with parts of the cage 14 projecting out of the liner 12 as described below. The cage 14 is an additional structural component of the helmet 10. Moreover, the cage 14 has an impact on the improved aerodynamics of the helmet 10 over existing foam liner helmets in the manner described below.

The liner 12 has a plurality of beams 20 and 21 extending in a streamline direction from front 22 to the rear 23 of the helmet 10, and forming the hemispherical body of the helmet 10. A pair of peripheral beams 20 are provided on opposite sides of the helmet 10 to form the circumference of the helmet 10. The peripheral beams 20 therefore form an annular shape about the wearer's head, starting from the front 22 to the tail 23. It is observed that the peripheral beams 20 may be ergonomically designed to surround the ears of the wearer. Moreover, the peripheral beams 20 may have openings such as those illustrated by 24 and 25, to allow air circulation/moisture evacuation.

Likewise, inward beams 21 extend in the streamline direction from the front 22 to the rear 22 of the helmet 10. It is observed that the peripheral beams 20 are all interconnected at the front 22, to then diverge from the front 22, and converge toward the rear 23. The inward beams 21 are spaced apart from one another and from the peripheral beams 20, thereby forming vents 30, with pointy end shapes. As shown, the vents 30 are elongated slots extending from a frontal portion to a rearward portion of the liner 12. The vents 30 are not obstructed by transverse portions of foam liner, i.e., the foam material bounds the periphery of the vents from a front pointy end 30A to a rear pointy or open end 30B, with the entire volume of the vent being free of foam material.

The cage 14, as shown in FIGS. 2 and 3, may consist of numerous segments, such as the frontal segment 40, the central segment 50 and the rear segment 60. The three different segments 40, 50 and 60 may each be individually molded and assembled in the manner shown in FIG. 3. Other configurations are considered, such as the use of a pair of segments or of multiple parts to form the configuration shown in FIG. 3.

The frontal segment 40 has a transverse bridge member 41. Transverse bridge member 41 is referred to as being transverse in relation to the front to rear streamline orientation of the helmet 10. The transverse bridge member 41 is constituted of a middle bridge 42 and a pair of side bridges 43. It is observed that the front edges of the middle bridge 42 and the side bridges 43 are concave, forming a V shape concavity. As explained hereinafter, this concave shape is designed to increase the air intake in the vents 30. Moreover, the front edges of the bridges may have downwardly projecting lips 42A/43A, rigidifying the bridges in a transverse orientation of the helmet 10. However, so as to reduce the drag, the lips 42A/43A, and similar lips of other bridges, are of relative small dimensions, such as a rectangular section of 2.0 mm×2.0 mm. Ribs of similar dimensions as the lips 42A/43A may also be provided on undersides of the bridges 42 and 43, to increase the rigidity of the bridges. Openings 44 are defined at the intersection between the middle bridge 42 and the side bridges 43. Other openings 45 are provided at ends of the side bridges 43. The openings 44 are used to interconnect the frontal segment 40 to the central segment 50, as described hereinafter and shown in FIG. 3. The openings 45 allow foam penetration therethrough in the co-molding process between the inner liner 12 and the cage 14.

A U-shaped strip 46 projects downwardly from tips of the side bridges 43. The U-shaped strip 46 is typically integral with the side bridges 43. A U-shaped base 47 is connected to a bottom of the U-shaped strip 46. The strips 46 and 47 constitute anchoring elements of the cage 14 in that they will be concealed and captive in the inner liner 12.

Arms 48 project laterally from opposite sides of the U-shaped base 47, for alignment with the central segment 50. It is observed that triangular tabs B are provided all over the U-shaped strip 46. These triangular tabs are also found in the central segment 50 and the rear segment 60, and are used to properly position the cage 14 in the mold prior to the co-molding step, by abutment with the mold cavity surface.

Still referring to FIGS. 2 and 3, the central segment 50 is shown as having another transverse bridge member 51. The transverse bridge member 51 also comprises a middle bridge 52, but two pairs of side bridges 53 on each side of the middle bridge 52. In similar fashion to the bridges 42 and 43, the bridges 52 and 53 show a concave edge, for instance with a V like shape, etc, with lips 52A/53A. Arms 54 project forwardly from the junction between the middle bridge 52 and a first set of the side bridges 53. The arms 54 will be received in the openings 44 of the frontal segment 40 in the manner shown in FIG. 3. Hence, when the cage 14 is co-molded to the liner 12, the foam material of the liner 12 will hold the arms 54 fixed relative to the openings 44 and thus maintain the frontal segment 40 and central segment 50 interconnected. Openings 55 are rearwardly positioned relative to these arms 54 and will serve a similar purpose by receiving corresponding arms of the rear segment 60, in the manner shown hereinafter. Other openings 56 are defined at various locations in the side bridges 53. These openings 56 allow foam penetration through the transverse bridge member 51 in the co-molding process. It is shown that some fins 56A are lodged at various locations along the side bridges 53, and such fins increase the contact surface between the foam of the liner 12 and the cage 14, to increase the bond therebetween after co-molding.

Loops 57 are provided on opposite sides of the central segments 50 and form the base of the transverse bridge member 51. Clearances 58 are defined at the tips of the loops 57, and will accommodate the tips of the arms 48 of the frontal segment 40. Loops 59 relate the loops 57 to a remainder of the transverse bridge member 51. Both sets of loops 57 and 59 are concealed within the inner liner 12 and retained by the foam material. The loops 57 and 59 may allow air circulation therethrough if vents are provided thereat in the liner 12. Slots 59A are provided in a front portion of the central segment 50, the slots 59A being used as anchors for straps of the attachment system 11.

The rear segment 60 also has a transverse bridge member 61 made of a middle bridge 62 and pairs of side bridges 63 on opposite sides of the middle bridge 62, with lips 62A and 63A similar to the lips 42A/42B. Openings 64 are located on opposite sides of the middle bridge 62 and allow foam penetration therethrough during the co-molding process between the liner 12 and the cage 14. Arms 65 project forwardly, and will be received in the openings 55 of the central segment 50. Fingers 67 are also defined as projecting from side bridges 63. These fingers 67 will contact the central segment 50 to increase a contact surface between the central segment 50 and the rear segment 60 of the cage 14. In a similar fashion to the central segment 50, loops 68 and 69 are provided on both ends of the transverse beam member 61. The loops 68 and 69 form the base of the transverse beam member 61. A plurality of rearward strips 70 project from the various edges of the transverse beam member 61 and form an arched portion, defining the rear portion of the cage 14 at the rear 23 of the helmet 10.

Figure 4:
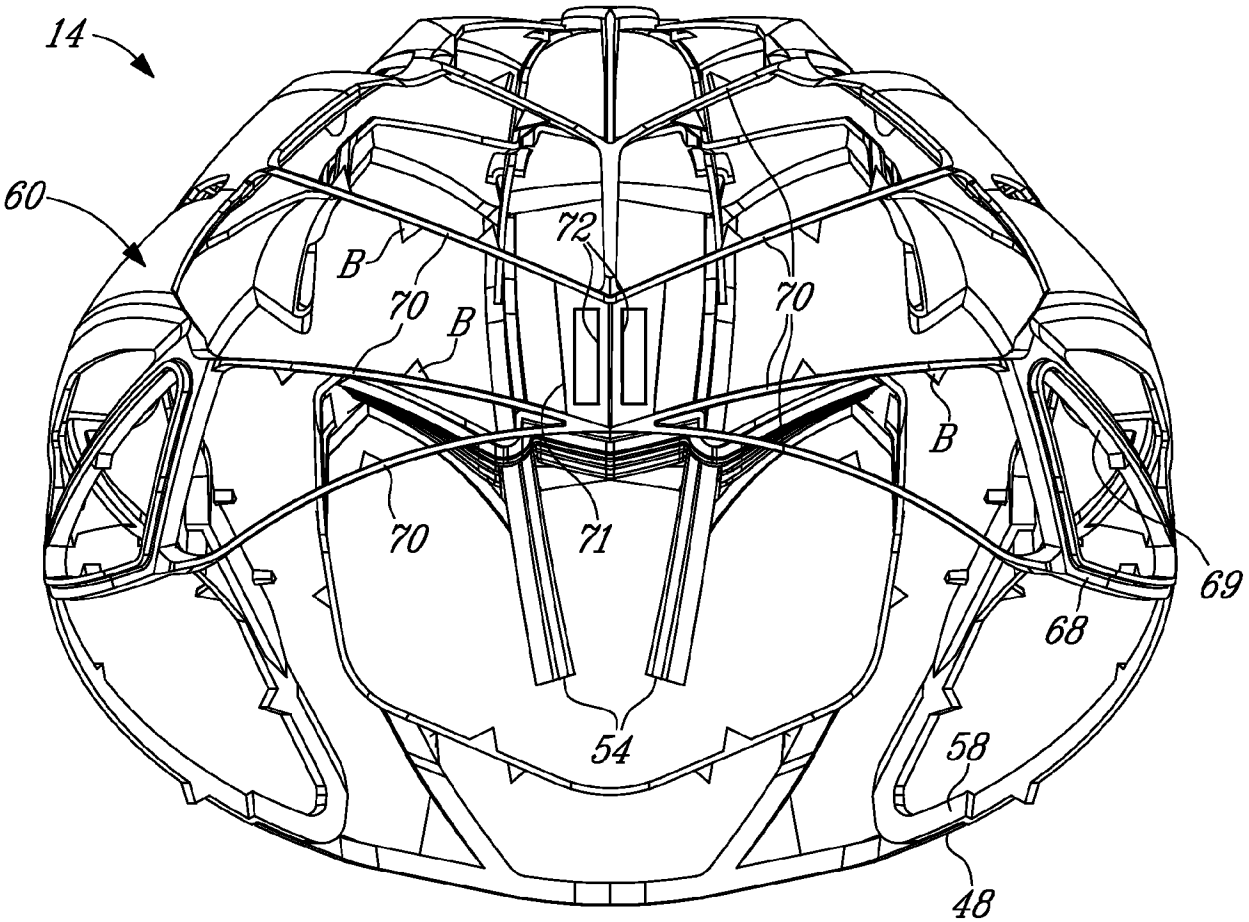
FIG. 4 is a rear view of the helmet of FIG. 1.

Referring to FIG. 4, a connection block 71 is a node for the strips 70, which converge to the block 71 and are integral therewith. The block 71 has a pair of slots 72 of elongated shape, parallel to one another. The block 71 is embedded in the foam material of the inner liner 12, but corresponding clearances are defined in the foam material of the inner liner 12 and the outer shell 13, for the slots 72 to be open to an inner surface and outer surface of the helmet 10. A strap of the attachment system 11 may be anchored to the helmet 10 by looping through the slots 72. In an embodiment, a single strap extends from one ear to another and passes through the slots 72. Accordingly, the strap is well anchored to the back of the helmet 10, by passing through the slots 72 and thus by looped around a portion of the helmet 10 including the inner liner 12, and the cage 14. The outer shell 13 may also be present at the anchor location. Likewise, an end of the straps of the attachment system 11 are anchored to the central portion 50 of the cage 14, by passing through the slots 59A. The straps of the attachment system 11 are therefore comolded into the helmet 10, and are anchored to the parts of the helmet 10 featuring both the inner liner 12 and the cage 14, i.e., parts with relative high structural properties.

Referring to FIG. 1, it is shown that the various middle bridges 42, 52 and 62, and side bridges 43, 53 and 63 project out of the foam material of the beams 20 and 21 bounding the vents 30, and are spaced apart from one another, from front 22 to rear 23. The bridges 42, 43, 52, 53, 62 and 63 are all transversely positioned in the vents 30 of the helmet 10, relative to the streamline orientation (i.e., from front 22 to rear 23). Hence, the bridges 42, 43, 52, 53, 62 and 63 act as the sole structural members between the beams 20 and 21. The bridges 42, 43, 52, 53, 62 and 63 are made of a rigid polymer, such as Nylon 6, among other possibilities. According to an embodiment, the portion of these bridges extending through the vents 30 are substantially planar. These bridges are hence a substitute for transverse bridges of foam material. However, in comparison with foam material, for a same structural support, these bridges are substantially thinner. Accordingly, the transverse drag surface of the helmet 10 is reduced over the substantially thicker bridges of foam material, resulting in a reduced drag coefficient on the air intake side of the vents 30. Hence, the bridges perform a similar structural function as the prior-art foam bridges did, while providing a more aerodynamic shape. As shown, a single vent 30 may feature three of the these bridges in front-to-rear succession.

Figure 5:
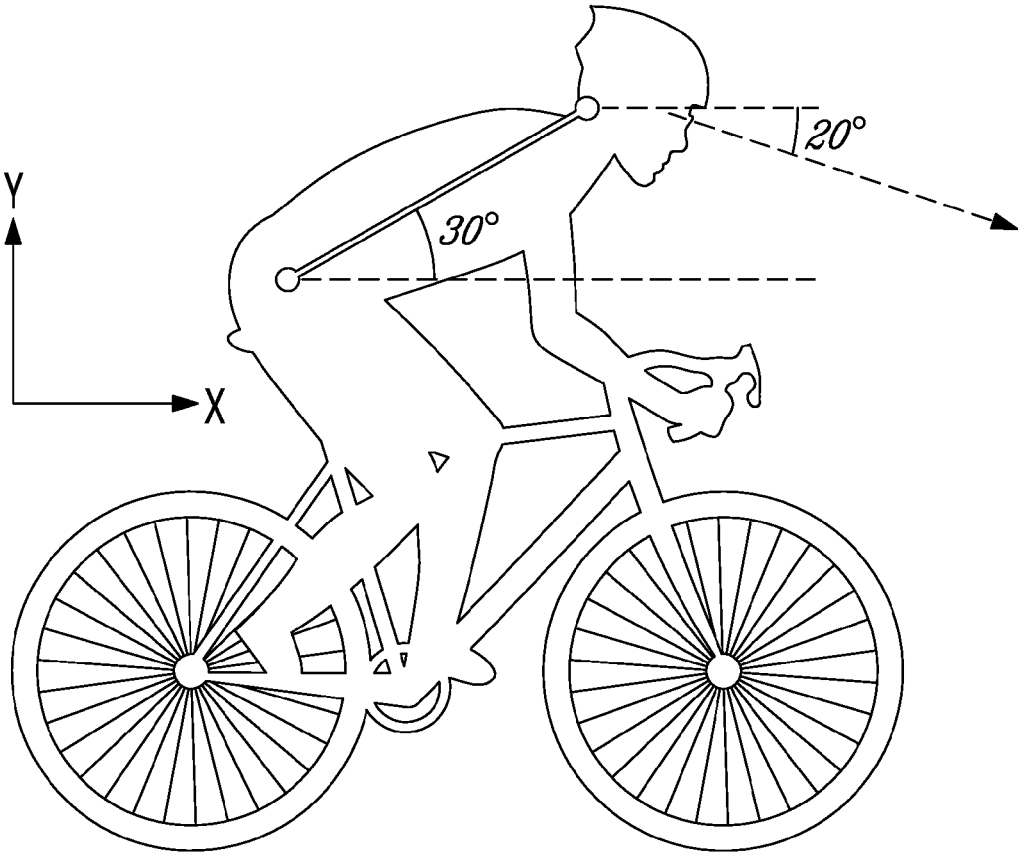
FIG. 5 is a schematic showing the typical head orientation of a rider on a bicycle.

Referring to FIG. 5, a relatively usual rider position on a road bike is shown, the rider position being that of a racing or cyclosport position. Due to the inclination of the torso (i.e., 30 degrees from the horizon), the anterior-posterior axis at the level of the eyes is about 20 degrees below the horizon (when the rider is on a substantially horizontal surface). The plane of the portion of the bridges 42, 43, 52, 53, 62 and 63 extending through the vents 30 is oriented as a function of the 20 degrees below the horizon, i.e., at least some of these planes are oriented to be parallel to the streamline of the bike moving in a straight line. The stream line of the bike is shown by axis X in FIG. 5. Stated differently, when the bottom of the inner liner 12 is on a horizontal plane and hence the cranial-caudal axis of the helmet 10 is vertical, i.e., as if the rider is off the bike and standing vertical (i.e., parallel to axis Y in FIG. 5), an anterior-posterior orientation (from front 22 to rear 23 in FIG. 1) of the planes of at least some of the bridges 42, 43, 52, 53, 62 and 63 is at +20 degrees ±5 degrees from the horizon.

While the bridge members 40, 50 and 60 are described as being part of the cage 14, it is considered to have the bridge members 40, 50, 60 being individually present in the helmet 10, and not related as a cage. However, in such a case, there should be a sufficient substantial portion of bridge material concealed inside the inner liner 12, to provide suitable anchoring of the bridge members 40, 50 and 60 in the inner liner 12.

The invention claimed is:

1. A helmet comprising:

an inner liner made of a single piece of foam material forming a body of the helmet, the inner liner having a convex outer surface and a concave inner surface defining a cavity adapted to receive a wearer's head, the inner liner having a plurality of beams extending from front to rear of the helmet and spaced apart to form vents therebetween, the vents being free of foam material between adjacent beams;

at least one rigid bridge member comolded with the inner liner to be partially concealed in the inner liner, the at least one bridge member having at least one bridge projecting out of the foam material of two adjacent beams and extending transversely in at least one of the vents, the at least one bridge projecting out of the foam material of two adjacent beams being free of the foam material; and at least one strap adapted to attach the helmet to a wearer's head.

2. The helmet according to claim 1, further comprising an outer shell integrally connected to the inner liner and covering at least partially the convex outer surface of the inner liner.

3. The helmet according to claim 1, wherein the at least one bridge member projects transversely through a plurality of the vents as intermittently concealed in the foam material of the bridges between the vents, forming a transverse sequence of bridges.

4. The helmet according to claim 1, further comprising three of said bridge members, the bridge members being spaced apart from one another from front to rear of the helmet.

5. The helmet according to claim 1, wherein the at least one bridge member is part of a cage, the cage having at least two cage segments with each said cage segment having one said bridge member, the bridge members being spaced apart from one another from front to rear of the helmet.

6. The helmet according to claim 5, wherein the cage segments are interconnected by arms of one said cage segment penetrating slots of another cage segment, when comolded in the foam material.

7. The helmet according to claim 1, wherein the at least one bridge member has slots in portions thereof concealed in the foam material for penetration of the foam material through the slots.

8. The helmet according to claim 1, wherein a front edge of the bridge transversely in the vent has a concave outline.

9. The helmet according to claim 1, wherein a front edge of the at least one bridge transversely in the vent has a lip projecting toward the concave inner surface.

10. The helmet according to claim 1, wherein at least one of the bridges transversely in the vent is substantially planar, said bridge having an anterior-posterior axis at an angle of 20 degrees ±5 degrees relative to a cranial-caudal axis of the helmet when the cranial-caudal axis of the helmet is vertical.

11. The helmet according to claim 1, wherein the at least one bridge member has at least two bridges interconnected to one another, with a plurality of strengthening fins at a junction between adjacent ones of the bridges.

12. The helmet according to claim 1, wherein at least one of said bridge member projects transversely through a plurality of the vents as intermittently concealed in the foam material of the bridges between the vents, whereby a single one of said bridge member forms a transverse sequence of bridges relative to the beams.

13. The helmet according to claim 4, wherein each of said three bridge member projects transversely through a plurality of the vents as intermittently concealed in the foam material of the bridges between the vents, whereby each of said three bridge members forms a transverse sequence of bridges relative to the beams.

* * * * *